United States Patent [19]

Kanai

[11] 4,308,611

[45] Dec. 29, 1981

[54] MOUNTING STRUCTURE FOR THE GLASS IN THE WATCH CASE

[75] Inventor: Kohtaro Kanai, Tanashi, Japan

[73] Assignee: Citizen Watch Co., Ltd., Tokyo, Japan

[21] Appl. No.: 31,932

[22] Filed: Apr. 20, 1979

[30] Foreign Application Priority Data

Apr. 28, 1978 [JP] Japan ..... 53/58621[U]

[51] Int. Cl.[3] ..... G04B 37/00

[52] U.S. Cl. ..... 368/294; 368/295; 368/291; 368/292

[58] Field of Search ..... 58/91, 88 R, 90 R, 53, 58/54, 55, 56; 368/294, 295, 291, 292

[56] References Cited

U.S. PATENT DOCUMENTS 3,858,388 1/1975 Fujimori et al. ..... 58/91 X 3,934,402 1/1976 Fujimori ..... 368/292

FOREIGN PATENT DOCUMENTS 2823890 8/1978 Fed. Rep. of Germany ..... 58/91

521986 6/1955 Italy ..... 58/91

*Primary Examiner*—Ulysses Weldon

*Attorney, Agent, or Firm*—Birch, Stewart, Kolasch & Birch

[57] ABSTRACT

A mounting structure for the glass in a watch case comprising a bezel having an overhang, a plastic joint engaged with the inside of the bezel, and an inner supporting ring engaged with the bezel with the plastic joint interposed therebetween. The glass is held by the overhang of the bezel and the upper surface of the inner supporing ring at the beveled peripheral portion. The bezel or the inner supporting ring is engaged with the watch case interposing a plastic joint.

4 Claims, 4 Drawing Figures

MOUNTING STRUCTURE FOR THE GLASS IN THE WATCH CASE

BACKGROUND OF THE INVENTION

The present invention relates to a watch case and more particularly to a mounting structure for the glass of the case.

Heretofore, inorganic glass has been secured to the wristwatch case by adhesives. In such a glass mounting, certain inconveniences on the working and during the mounting process have been encountered. For example, the glass and watch case must be manufactured with a high degree of accurace and the quantity of the adhesives and the drying temperature must be severely controlled to obtain the desired adhesion. Also, the overflow adhesives must be removed by manual operation.

In order to eliminate the disadvantages of the conventional structure, there has been proposed a glass mounting structure in which the glass is secured to the bezel of the watch case through a circular, waterproof joint made of a resin, such as polycarbonates, Delrin, and Teflon, without using adhesives. However, in such a mounting structure, a part of the joint is exposed to the outside through a gap between the bezel and the glass, which adversely affects the appearance of the watch. Furthermore, the bezel must be made to have a height sufficient for receiving the glass, which results in an increase in the thickness of the watch.

SUMMARY OF THE INVENTION

It is an object of the present invention to provide a structure which enables the mounting of the inorganic glass to the watch case without exposing the joint and without increasing the thickness of the watch.

In accordance with the present invention, the mounting structure comprises a bezel having an inner overhang and a joint receiving portion, a plastic joint provided in said joint receiving portion, a glass having a peripheral beveled portion, said peripheral beveled portion being abutted on said overhang of the bezel and the periphery of said glass being pressed against said joint, an inner supporting ring having a glass supporting surface and a joint receiving peripheral portion, said surface being abutted on the underside of said glass and said peripheral portion being pressed against said joint, at least one of said bezel and inner supporting ring being engaged with the case interposing a joint.

These and other objects and features of the present invention will be become fully apparent from the following detailed description in conjunction with the accompanying drawing.

DESCRIPTION OF THE PREFERRED EMBODIMENTS

Figure 1:
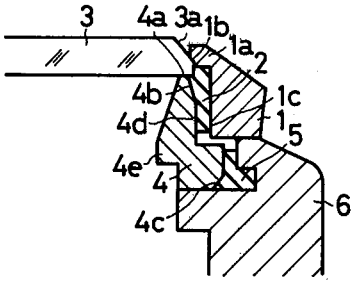
FIG. 1 is a sectional view of a glass mounting portion of a wristwatch according to the present invention.

Referring to FIG. 1 showing an embodiment of the present invention, the glass mounting structure comprises a bezel 1, a joint 2 of plastic, an inorganic glass 3, an inner supporting ring 4, a joint 5, and a watch case for supporting a movement (not shown).

The bezel 1 comprises an inner overhang 1*a*, a glass holding beveled portion 1*b* formed at the lower edge portion of said overhang, and a joint receiving portion 1*c* formed adjacent the underside of said overhang. The glass 3 has a peripheral beveled portion 3*a* for engagement with the glass holding beveled portion 1*b*. The inner supporting ring 4 comprises an upper supporting surface 4*a*, a beveled guiding portion 4*b* provided at the upper outer edge, a beveled guiding portion 4*c* provided at lower outer edge and a joint receiving peripheral portion 4*d*. The ring 4 further has an inner overhang 4*e* which overlaps the periphery of the dial (not shown).

To assemble the members, the joint 2 is engaged with the joint receiving inside portion 1*c* of the bezel 1 and the glass 3 is inserted into the bezel with the periphery thereof sliding on the joint 2. The peripheral beveled portion 3*a* is engaged with the glass holding beveled portion 1*b* and the periphery is pressed against the joint 2. The peripheral beveled portion 3*a* serves as a guide portion for insertion of the glass into the bezel 1, whereby the insertion may be easily performed. The inner supporting ring 4 is inserted into the bezel 1 with the beveled guiding portion 4*b* sliding on the joint 2. The supporting surface 4*a* abuts on the underside of the glass 3 to hold it and the peripheral portion 4*d* is pressed against the joint 2. The inner supporting ring 4 in the assembled device is engaged with the watch case 6 with the beveled guiding portion 4*c* sliding on the plastic joint engaged with the watch case. Thus, the glass may be mounted in the watch case in the fluid tight manner.

Figure 2:
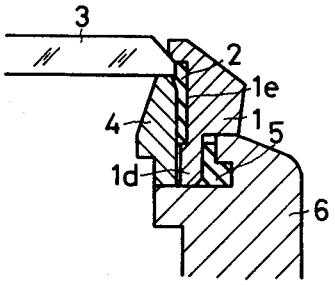
FIG. 2 is a sectional view showing another embodiment of the present invention.

Referring to FIG. 2 showing another embodiment of the present invention, the bezel 1 and the inner supporting ring 4 are different from that of FIG. 1 in sectional shape. The bezel 1 has an axially extending lower portion 1*d* and the joint 2 is engaged with the joint receiving groove 1*e*. The bezel 1 is inserted and engaged with the watch case 6 interposing the joint 5 provided in the groove 1*e*.

Figure 3:
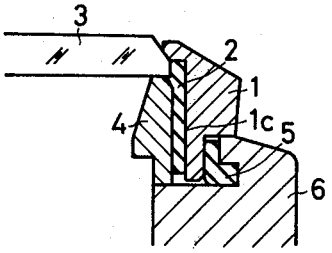
FIG. 3 is a sectional view showing a further embodiment of the present invention.

FIG. 3 shows a modification of FIG. 2, in which the joint receiving groove 1*e* is not formed in the bezel 1 and the simple joint receiving portion 1*c* is provided.

Figure 4:
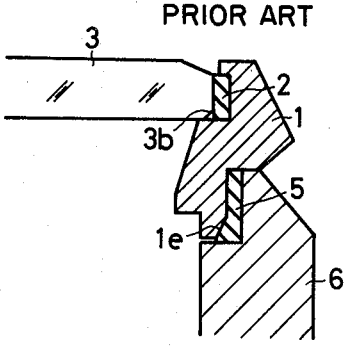
FIG. 4 PRIOR ART
FIG. 4 is a sectional view showing a conventional glass mounting structure.

FIG. 4 shows a conventional glass mounting structure which comprises the bezel 1 and the joint 2 engaged with the bezel. The glass 3 is inserted into the bezel from the upperside thereof with the beveled portion 3*b* sliding on the joint 2. The lower extension of the bezel 1 is inserted into the watch case 6 with the beveled guiding portion 1*e* sliding on the joint 5 engaged with the watch case. In the conventional structure, the bezel 1 must be made in a large size in height for receiving the glass and since a thin glass can not be inserted into the bezel, a thick glass must be used. As a result, thickness of the watch is increased.

In accordance with the present invention, since the glass is held by the overhang of the bezel and the inner supporting ring, a thin glass and a thin bezel may be used, whereby thickness of the watch may be decreased. In addition, a thin glass may be easily engaged with the bezel, and the joint is covered by the overhang of the bezel to provide a good appearance.

What is claimed is:

1. A structure for mounting a glass in a watch case comprising:

a bezel having an inner overhang and a first joint receiving portion;

a first joint means provided in said first joint receiving portion;

a glass having a peripheral beveled portion and a peripheral portion, said peripheral beveled portion abutting on said overhang of the bezel and said peripheral portion of said glass being pressed against said first joint means;

an inner supporting ring having a glass supporting surface and a first joint receiving peripheral portion, said glass supporting surface abutting on the underside of said glass and said first joint receiving peripheral portion being pressed against said first joint means without abutting on said bezel, whereby said bezel, glass, first joint and inner supporting ring are assembled into an integrated assembly; and means for engaging said integrated assembly with said watch case with a second joint means interposed therebetween, wherein the watch case is in engaging contact with the bezel and the inner supporting ring and the second joint means is in engaging contact with the watch case and the inner supporting ring.

2. A watch according to claim 1 in which said bezel has a glass holding beveled portion provided at the lower edge of said overhang.

3. A watch according to claim 1 in which said inner supporting ring has a beveled guiding portion provided at the upper outer edge.

4. The structure for mounting a glass in a watch case of claim 1, wherein the first joint means prevents direct contact between the bezel and the inner supporting ring.

* * * * *